US011106180B2

(12) United States Patent
Saglini

(10) Patent No.: US 11,106,180 B2
(45) Date of Patent: Aug. 31, 2021

(54) DATE AND MOON PHASE DISPLAY MECHANISM FOR WATCHES

(71) Applicant: ETA SA Manufacture Horlogere Suisse, Grenchen (CH)

(72) Inventor: Julien Saglini, Biel/Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 764 days.

(21) Appl. No.: 15/942,598

(22) Filed: Apr. 2, 2018

(65) Prior Publication Data

US 2018/0314209 A1 Nov. 1, 2018

(30) Foreign Application Priority Data

Apr. 28, 2017 (EP) ..... 17168584

(51) Int. Cl.

| | |
|---|---|
| ***G04B 19/253*** | (2006.01) |
| ***G04B 19/26*** | (2006.01) |
| ***G04B 19/247*** | (2006.01) |
| ***G04B 19/25*** | (2006.01) |

(52) U.S. Cl.

CPC ..... *G04B 19/25366* (2013.01); *G04B 19/247* (2013.01); *G04B 19/25* (2013.01); *G04B 19/268* (2013.01)

(58) Field of Classification Search

CPC .... G04B 19/26; G04B 19/262; G04B 19/268; G04B 19/25366; G04B 19/25

See application file for complete search history.

(56) References Cited

U.S. PATENT DOCUMENTS

| | | | | |
|---|---|---|---|---|
| 4,881,213 | A * | 11/1989 | Zaslawsky | G04B 19/268 368/15 |
| 5,222,051 | A * | 6/1993 | Dubois | G04B 19/266 368/19 |
| 5,367,504 | A * | 11/1994 | Ferenczy | G04B 19/25 368/15 |
| 5,724,318 | A | 3/1998 | Mossuz | |
| 2006/0007787 | A1* | 1/2006 | Born | G04B 19/268 368/15 |
| 2009/0274010 | A1 | 11/2009 | Vuilleumier et al. | |
| 2017/0075307 | A1* | 3/2017 | Merino | G04B 13/00 |

FOREIGN PATENT DOCUMENTS

| | | |
|---|---|---|
| CH | 706 266 A2 | 9/2013 |
| EP | 0 629 932 A1 | 12/1994 |
| EP | 1 677 165 A1 | 7/2006 |

OTHER PUBLICATIONS

European Search Report dated Nov. 9, 2017, issued in European Application EP 17168584.5, filed Apr. 28, 2017 (with English Translation of Categories of Cited Documents).

* cited by examiner

*Primary Examiner* — Daniel P Wicklund
(74) *Attorney, Agent, or Firm* — Oblon, McClelland, Maier & Neustadt, L.L.P.

(57) ABSTRACT

A date and moon phase display mechanism for watches, including a date ring with an inner toothing arranged to be driven by a timepiece movement, or arranged to cooperate with a date ring with an inner toothing of a timepiece movement, this mechanism including a moon display wheel set held in position by a moon jumper, this mechanism including drive devices, which are actuated by this inner toothing during each rotation of this date ring, and which are arranged to drive this moon display wheel set by a first constant angular pitch during each this rotation of this date ring.

13 Claims, 2 Drawing Sheets

DATE AND MOON PHASE DISPLAY MECHANISM FOR WATCHES

This application claims priority from European Patent Application No. 17168584.5 filed on Apr. 28, 2017, the entire disclosure of which is hereby incorporated herein by reference.

FIELD OF THE INVENTION

The invention concerns a date and moon phase display mechanism for watches, comprising a date ring with an inner toothing arranged to be driven by a timepiece movement, or arranged to cooperate with a date ring with an inner toothing of a timepiece movement, said mechanism comprising a moon display wheel set held in position by a moon jumper, wherein said mechanism comprises drive means, which are arranged to be actuated by said inner toothing during each rotation of said date ring, and which are arranged to drive said moon display wheel set by a first constant angular pitch during each said rotation of said date ring.

The invention also concerns a timepiece movement comprising a date ring with an inner toothing or comprising a drive wheel arranged to drive such a date ring with an inner toothing.

The invention also concerns a watch including such a timepiece movement and/or which includes such a mechanism.

The invention concerns the field of timepiece displays, more particularly astronomical and date displays.

BACKGROUND OF THE INVENTION

Astronomical and date displays in watches are complications that require space, are not always easy to integrate in an existing movement and can be quite expensive.

EP Patent Application No 0629932A1 in the name of Fabrique d'ébauches de Sonceboz discloses a timepiece having a date indicator with an internal toothing that moves angularly one step per day, at least one rotating indication means driven by said date indicator and intended to indicate cyclical parameters, such as the date, lunar phase or other. Several types of indications, all controlled by the date indicator, make it possible produce a variety of watches, of simple design, with different display combinations.

EP Patent Application No 1677165A1 in the name of ASULAB discloses a calendar mechanism actuated by a moon indicator and actuating Chinese calendar indicators. The mechanism has a month wheel set driven by a lever to make one revolution for each common year of twelve months and for each leap year of thirteen months. The moon indicator displays a lunar date on a scale and is driven by the clock movement to make one revolution for one or two synodic months.

CH Patent Application No 706266A2 in the name of OMEGA discloses a mechanism that comprises display devices including two drive mechanisms which are combined with each other to form a common drive mechanism. This common drive mechanism is driven by a timepiece movement. The display devices comprise two correction mechanisms which are combined to form a common correction mechanism. The common correction mechanism is driven by an actuator independent of the common drive mechanism.

SUMMARY OF THE INVENTION

The invention proposes to simplify the driving of date and moon phase mechanisms for watches, by creating a simple and reliable mechanism. The invention further proposes to develop a system for displaying the moon phase with a date mechanism having a coaxial hand, To this end, the invention concerns a date and moon phase display mechanism for watches according to claim 1.

The invention also concerns a timepiece movement comprising a date ring with an inner toothing or comprising a drive wheel arranged to drive such a date ring with an inner toothing.

The invention also concerns a watch including such a timepiece movement and/or which includes such a mechanism.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
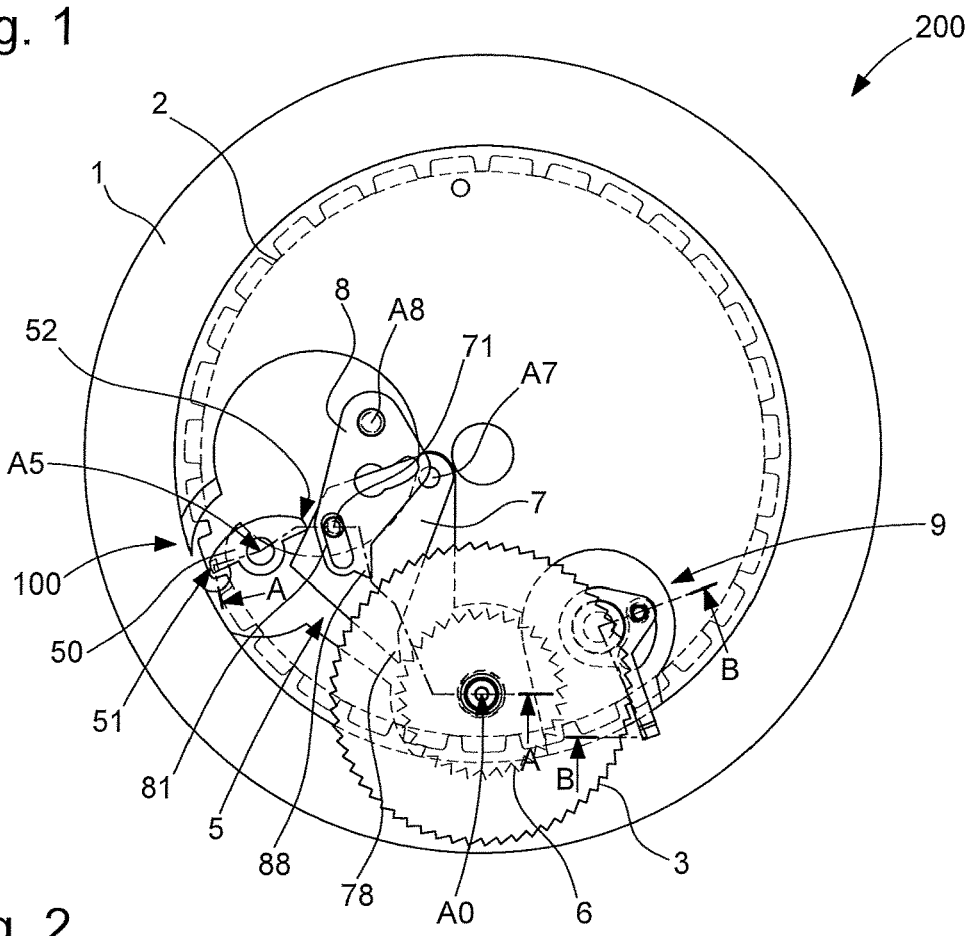
FIG. 1 represents a schematic, plan view of a timepiece movement comprising a date and moon phase display mechanism according to the invention, with a date ring having an inner toothing, which is represented, at eight o'clock, in a position where it approches an entry lever of the mechanism of the invention, which is in a resting position on a main lever, which comprises a pin arranged to drive a secondary lever, at the end the pin's travel in an oblong slot comprised in the secondary lever; the main lever comprises a main beak arranged to drive a main ratchet wheel forming a date display wheel set; the secondary lever comprises a secondary beak arranged to drive a secondary ratchet wheel forming a moon display wheel set; in this particular, non-limiting embodiment, the moon display wheel set and the date display wheel set are coaxial, at six o'clock, and the latter is arranged to carry coaxially a hand that is not represented in the Figure.
Figure 2:
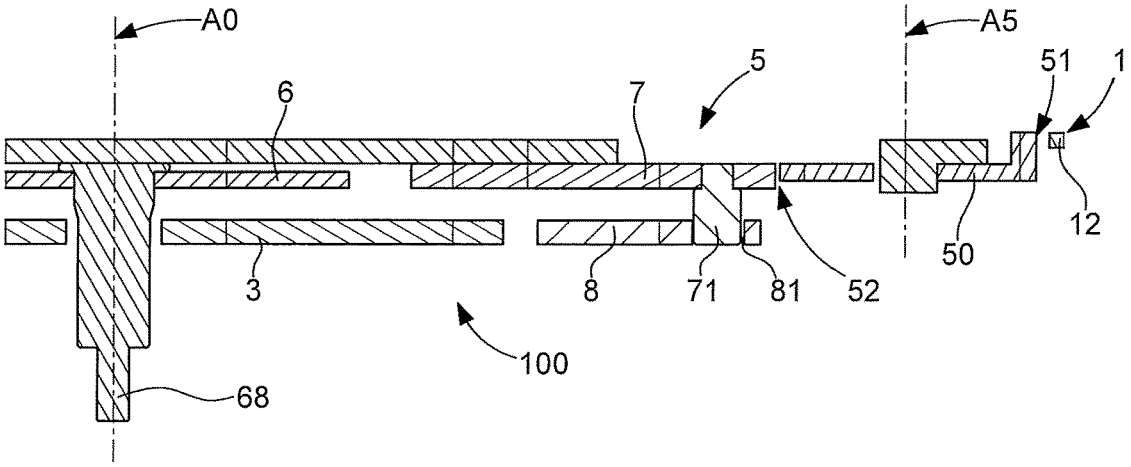
FIG. 2 represents the mechanism of FIG. 1, in a schematic cross-section along marks AA of FIG. 1, passing through the axes of the moon display wheel set and date display wheel set, of the pin between the main lever and the secondary lever, and of the entry lever.
Figure 3:
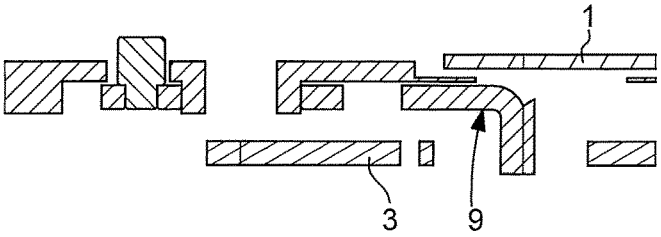
FIG. 3 represents the mechanism of FIG. 1, in a schematic cross-section along the marks BB of FIG. 1, passing through the axes of a moon display corrector, represented at five o'clock in FIG. 1.
Figure 7:
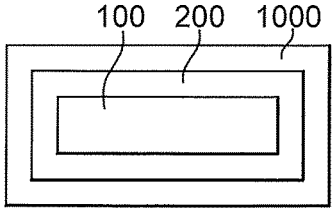
FIG. 7 is a block diagram representing a watch including a timepiece movement which in turn includes a mechanism of this type.
Figure 4:
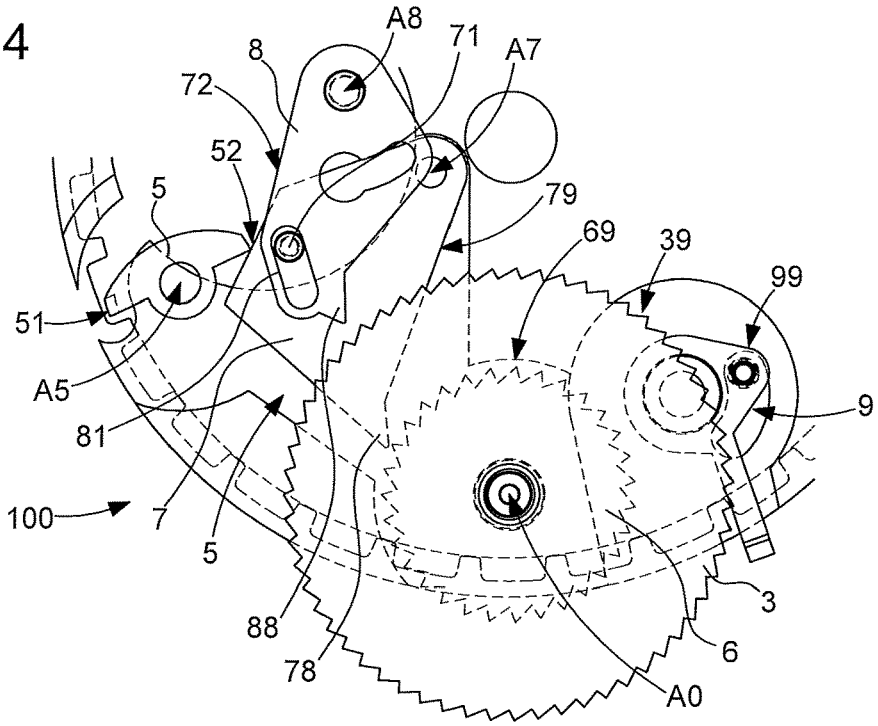
FIG. 4 represents, in a similar manner to FIG. 1, a detail of the same mechanism, at the instant when the date ring enters into contact with the entry lever, and when the main beak of the main lever is ready to drive the main ratchet wheel.
Figure 5:
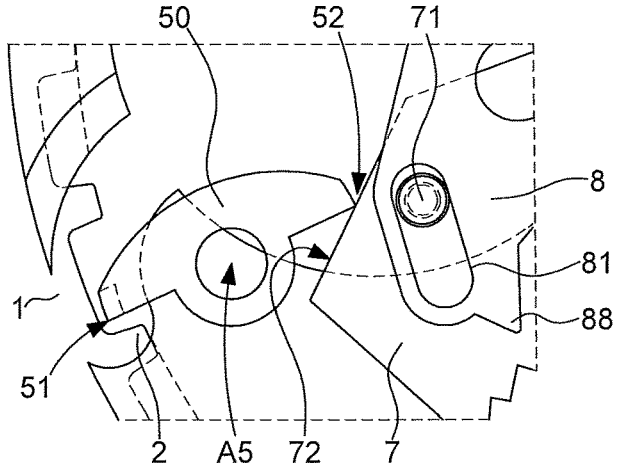
FIG. 5 is an enlarged detail of FIG. 4.
Figure 6:
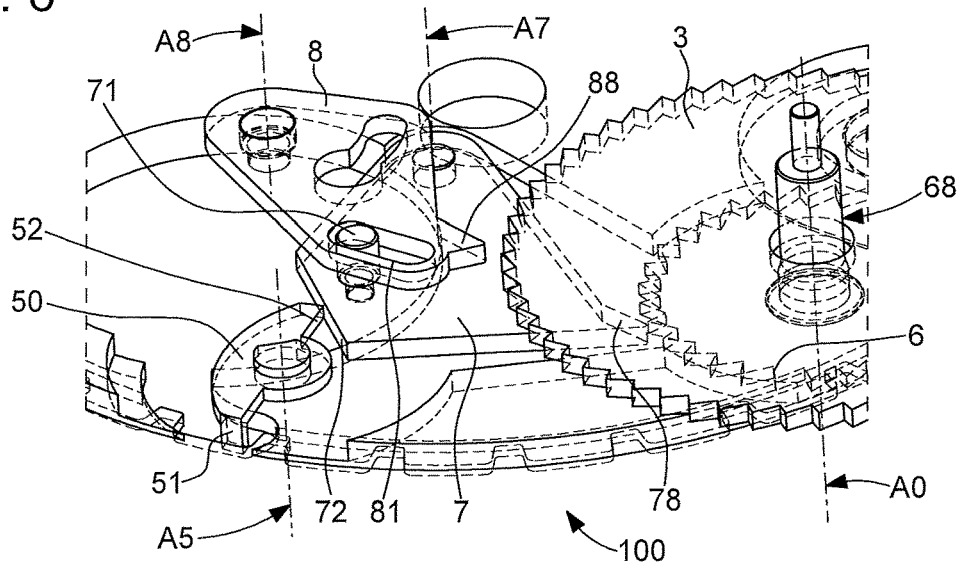
FIG. 6 is a perspective view of the same mechanism, in the same position as in FIGS. 4 and 5.

The invention concerns a date and moon phase display mechanism 100 for watches.

In a first variant, this mechanism 100 comprises a date ring 1 with an inner toothing 2, arranged to be driven by a timepiece movement 200. In a second variant, this mechanism 100 does not have a date ring 1 and is then arranged to cooperate with such a date ring 1 with an inner toothing 2 of a timepiece movement 200.

In one or other variant, mechanism 100 comprises a moon display wheel set 3, which is held in position by a moon jumper 39.

Mechanism 100 comprises drive means 5, which are arranged to be actuated by inner toothing 2 during each rotation of date ring 1. These drive means 5 are arranged to drive moon display wheel set 3, by a constant angular pitch, during each rotation of date ring 1.

The principle of the invention consists in driving a set of levers actuating moon phase and date wheels. In a particular, but non-limiting manner, the invention makes it possible to use a standard date indicator (the ETA 2824-2 movement, for example), and to add a module which is driven by the date indicator of the basic movement. It is to be noted that the two levers driving the moon phase and date mechanisms are preferably connected by an articulation, particularly on a pin.

According to the invention, drive means 5 comprise an entry lever 50 pivoting about an entry axis A5. This entry lever 50 comprises a first end 51, which is arranged to cooperate with inner toothing 2, and a second end 52, which is arranged to engage and push with a bearing surface 72 comprised in a main lever 7. This main lever 7 pivots about a main axis A7 and is arranged to directly or indirectly control the rotation of moon display wheel set 3.

More particularly, main lever 7 is arranged to indirectly control the rotation of moon display wheel set 3, via a secondary lever 8 pivoting about a secondary axis A8.

More particularly, main lever 7 and secondary lever 8 are arranged relative to one another to ensure a delay in movement of secondary lever 8 relative to main lever 7, when main lever 7 is driven by entry lever 50.

In a particular, non-limiting embodiment illustrated by the Figures, main lever 7 comprises a pin 71 moving inside an oblong slot 81 comprised in secondary lever 8, to prevent blocking of main lever 7 and secondary lever 8 since main axis A7 and secondary axis A8 are distinct. In a particular application, this oblong slot 81 can be adjusted in length to ensure the delay in movement of secondary lever 8 relative to main lever 7, when main lever 7 is driven by entry lever 50. This delay can prevent a peak in energy consumption, which would occur in the event that the date display and moon phase display were driven simultaneously.

More particularly, main lever 7 is resting on a main jumper 79, which tends to oppose the thrust force imparted by entry lever 50 to main lever 7.

More particularly, mechanism 100 comprises a date display wheel set 6, which is held in position by a date jumper 69. Main lever 7 is arranged to directly control the rotation of date display wheel set 6 by a second constant angular pitch during each rotation of date wheel 1.

In the variant illustrated by the Figures, main lever 7 comprises a main beak 78 arranged to drive a main ratchet wheel forming date display wheel set 6, and secondary lever 8 comprises a secondary beak 88 arranged to drive a secondary ratchet wheel forming moon display wheel set 3.

In the illustrated variant, moon display wheel set 3 and date display wheel set 6 are coaxial, and the latter is arranged to carry a hand coaxially. In this particular variant, moon display wheel set 3 has the same direction of rotation as date display wheel set 6.

More particularly, moon display wheel set 3 and date display wheel set 6 are two ratchet wheels with opposite directions.

More particularly, moon display wheel set 3 has 59 teeth, and date display wheel set 6 has 31 teeth.

More particularly, mechanism 100 includes moon display correction means 9, which are arranged to be operated by a user, for example via a pusher, against a moon correction jumper 99. In the particular illustrated example, the corrector is rotated over an angular displacement of approximately 10° about its axis; its actuation is made possible by an intermediate wheel system in the basic movement, which allows a rapid correction to be made via the control stem of the movement.

More particularly, mechanism 100 includes, in a similar manner, date display correction means 4, which are arranged to be operated by a user, for example via a pusher, against a date correction jumper 49.

More particularly, mechanism 100 forms an independent module, which can be superposed on a timepiece movement 200, this movement 200 comprising a date ring 1 with an inner toothing 2 or comprising a drive wheel arranged to drive such a date ring 1 with an inner toothing 2.

The invention also concerns a timepiece movement 200 comprising a date ring 1 with an inner toothing 2, or comprising a drive wheel arranged to drive such a date ring 1 with an inner toothing 2. According to the invention, this timepiece movement 200 comprises such a mechanism 100, which is arranged to be driven by date ring 1, or respectively which includes a date ring 1 arranged to be driven by the drive wheel.

The invention also concerns a watch 1000 including such a timepiece movement 200 and/or which includes such a mechanism 100.

The invention allows a standard date indicator (for example of the ETA 2824-2 type) to be used for driving.

Naturally, alternatively and/or in addition to the moon phase display, the invention makes it possible to produce, in the same manner, a similar display, such as a tide or other display.

The invention offers an alternative to the usual date display inside an aperture, with the possibility, based on the same mechanism and at the cost of few transformations, of a display using the date hand.

The common driving of the moon phase and date mechanisms limits the number of components.

The invention is well suited for making an additional module.

What is claimed is:

1. A date and moon phase display mechanism for watches, comprising:

a moon display wheel set held in position by a moon jumper; and drive means, which is arranged to be actuated by an inner toothing during each rotation of a date ring, and which is arranged to drive said moon display wheel set by a first constant angular pitch during each said rotation of said date ring, wherein said drive means includes an entry lever that pivots about an entry axis and includes a first end which is arranged to cooperate with said inner toothing, and a second end which is arranged to engage and push a bearing surface comprised in a main lever that pivots about a main axis and is arranged to directly or indirectly control a rotation of said moon display wheel set, and the mechanism includes the date ring with the inner toothing arranged to be driven by a timepiece movement, or is arranged to cooperate with the date ring with the inner toothing of the timepiece movement.

2. The mechanism according to claim 1, wherein said main lever is arranged to indirectly control the rotation of said moon display wheel set, via a secondary lever pivoting about a secondary axis.

3. The mechanism according to claim 2, wherein said main lever and said secondary lever are arranged relative to one another to ensure a delay in movement of said secondary lever relative to said main lever when said main lever is driven by said entry lever.

4. The mechanism according to claim 3, wherein said main lever includes a pin moving inside an oblong slot comprised in said secondary lever, to ensure said delay in the movement of said secondary lever relative to said main lever, when said main lever is driven by said entry lever.

5. The mechanism according to claim 1, wherein said main lever is resting on a main jumper which tends to oppose a thrust force imparted by said entry lever to said main lever.

6. The mechanism according to claim 1, wherein said mechanism comprises a date display wheel set held in position by a date jumper, and said main lever is arranged to directly control a rotation of said date display wheel set, by a second constant angular pitch during each said rotation of said date ring.

7. The mechanism according to claim 6, wherein said moon display wheel set and said date display wheel set are two ratchet wheels with opposite directions.

8. The mechanism according to claim 7, wherein said moon display wheel set has 59 teeth, and said date display wheel set has 31 teeth.

9. The mechanism according to claim 6, wherein said mechanism comprises date display correction means arranged to be operated by a user against a date correction jumper.

10. The mechanism according to claim 1, wherein said mechanism comprises moon display correction means arranged to be operated by a user against a moon correction jumper.

11. The mechanism according to claim 1, wherein said mechanism forms an independent module that is able to be superposed on said timepiece movement, the timepiece movement comprising said date ring with said inner toothing, or a drive wheel arranged to drive said date ring with said inner toothing.

12. A timepiece movement, comprising:

said date ring with said inner toothing; and said mechanism according to claim 1, which is arranged to be driven by said date ring, or a drive wheel arranged to drive said date ring with said inner toothing; and said mechanism, which includes said date ring arranged to be driven by said drive wheel.

13. A watch including said timepiece movement according to claim 12.

* * * * *